US007887435B2

(12) United States Patent
Nishitani

(10) Patent No.: US 7,887,435 B2
(45) **Date of Patent: *Feb. 15, 2011**

(54) GOLF CLUB HEAD

(75) Inventor: Masafumi Nishitani, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 818 days.

This patent is subject to a terminal disclaimer.

(21) Appl. No.: 11/182,850

(22) Filed: Jul. 18, 2005

(65) Prior Publication Data

US 2005/0250597 A1 Nov. 10, 2005

Related U.S. Application Data

(63) Continuation of application No. 10/414,053, filed on Apr. 16, 2003, now Pat. No. 6,932,718.

(30) Foreign Application Priority Data

May 27, 2002 (JP) ..... P2002-152610

(51) Int. Cl.
*A63B 53/04* (2006.01)

(52) U.S. Cl. ..... 473/345; 473/349

(58) Field of Classification Search ..... 473/324, 473/335, 349, 345, 346, 338, 290, 291
See application file for complete search history.

(56) References Cited

U.S. PATENT DOCUMENTS 4,076,254 A * 2/1978 Nygren ..... 473/337
5,056,705 A 10/1991 Wakita et al.
5,064,197 A * 11/1991 Eddy ..... 473/326
5,421,577 A 6/1995 Kobayashi
5,755,624 A 5/1998 Helmstetter
5,797,807 A 8/1998 Moore
5,830,084 A 11/1998 Kosmatka
5,961,394 A 10/1999 Minabe
5,967,904 A 10/1999 Nagai et al.
6,043,420 A * 3/2000 Arnold ..... 84/411 M
6,062,988 A 5/2000 Yamamoto
6,206,789 B1 3/2001 Takeda
6,254,494 B1 7/2001 Hasebe et al.
6,348,015 B1 * 2/2002 Kosmatka ..... 473/342
6,371,868 B1 4/2002 Galloway et al.
6,494,790 B1 12/2002 Toyota et al.

(Continued)

FOREIGN PATENT DOCUMENTS

JP 11-347156 A 12/1999

(Continued)

*Primary Examiner*—Sebastiano Passaniti
(74) *Attorney, Agent, or Firm*—Sughrue Mion, PLLC

(57) ABSTRACT

A golf club head is a hollow head made of metal, preferably titanium or a titanium alloy. The golf club head has a face portion, a crown portion, a sole portion, a side portion, and a hosel portion. A thin and small plate made of metal is fixedly attached to the internal surface of the sole portion on the toe side so as to be in tight contact with the internal surface. The thin and small plate made of metal preferably has a thickness of 0.2 mm-1.2 mm, particularly 0.4 mm-1.1 mm, more particularly 0.5 mm-1.0 mm, and a weight of 0.5 g-1.5 g, particularly 0.6 g-1.0 g.

17 Claims, 5 Drawing Sheets

U.S. PATENT DOCUMENTS

| | | | | |
|---|---|---|---|---|
| 6,573,441 | B2 * | 6/2003 | Norris, Jr. | 84/411 M |
| 6,645,087 | B2 | 11/2003 | Yabu | |
| 6,932,718 | B2 * | 8/2005 | Nishitani | 473/345 |
| 2002/0160858 | A1 * | 10/2002 | Lee | 473/345 |

FOREIGN PATENT DOCUMENTS

| | | | |
|---|---|---|---|
| JP | 2000-254260 | A | 9/2000 |
| JP | 2001-054596 | * | 2/2001 |

* cited by examiner

GOLF CLUB HEAD

This is a continuation of application Ser. No. 10/414,053 filed Apr. 16, 2003, now U.S. Pat. No. 6,932,718 the entire disclosure of which is incorporated herein by reference.

The present disclosure relates to the subject matter contained in Japanese Patent Application No. 2002-152610 filed on May 27, 2002, which is incorporated herein by reference in its entirety.

BACKGROUND OF THE INVENTION

1. Field of the Invention

The present invention relates to a hollow golf club head made of metal, and particularly relates to a golf club head having a shape of a wood type or a shape approximating the shape of the wood type.

2. Description of the Related Art

Hollow metal heads has been used broadly as wood type golf club heads for drivers or fairway woods. Generally, as shown in FIG. 6, a wood type hollow golf club head 1 has a face portion 2 for hitting a ball, a crown portion 3 forming a top surface portion of the golf club head, a sole portion 4 forming a bottom surface portion of the golf club head, a side portion 5 forming toe-side, back-side and heel-side side surface portions of the golf club head, and a hosel portion 6. A shaft 7 is inserted into the hosel portion 6 of the golf club head 1, and fixed thereto by a bonding agent or the like. Incidentally, recently, many golf club heads called utility clubs have been commercially available. Various golf club heads similar to the wood type golf club head (that is, having a face portion, a sole portion, a side portion and a crown portion) have been commercially available as a kind of utility golf club head.

An aluminum alloy, stainless steel or a titanium alloy is used as a metal forming the hollow golf club head. In recent years, particularly a titanium alloy has been used broadly.

Incidentally, the naming of the wood type golf club head is derived from persimmon, which has been used for a long time as a raw material of the wood type golf club head. Golf club heads made of metal have been in poor demand particular for experienced golfers because the sound of hitting a ball is higher-pitched than that with a persimmon head. Various measures have been taken to reduce the shrill sound of hitting a ball. As one of the measures, there is a technique in which a metal sheet is joined to an internal surface of a golf club head at a center of a sole portion (JP-A-Hei.11-347156), and a technique in which a metal sheet is spot-welded to the internal surface of a golf club head on the heel side of a sole portion, and a gap of 0.02-0.2 mm is formed between the metal sheet and the sole portion (JP-A-2000-254260).

However, along with the popularization of wood type golf club heads made of metal, recently, the metallic shrill sound of hitting a ball peculiar to the wood type golf club heads made of metal is preferred inversely with the previous tendency. That is, the shrill sound of hitting a ball generated when the ball is hit on a sweet spot of a golf club head is preferred as proof of a good shot. Thus, the persimmon-tone sound of hitting a ball is disliked as a sound giving no impression of a short carry of a ball.

SUMMARY OF THE INVENTION

In consideration of such circumstances, it is an object of the invention to provide a golf club head with which the sound of hitting a ball is so high-pitched and clear that a golfer using the golf club head can enjoy a sense of supreme satisfaction.

A golf club head according to the invention is a hollow golf club head made of metal, including a face portion, a sole portion, a side portion, a crown portion, and a plate piece made of metal and fixedly attached to an internal surface of the golf club head on a toe side of the sole portion so that one of surfaces of thereof is in tight contact with the sole portion.

The golf club head according to the invention generates a clear and high-pitched sound when a ball is hit, particularly when a ball is hit on a sweet spot of a golf club head. Thus, the golf club head gives a deep sense of satisfaction to a golfer using the golf club head. In addition, the golfer can know achievement of a long carry. Accordingly, the strain to make a big shot by force is suppressed on and after the next shot. Thus, missed shots will be avoided before occurring.

It is preferable that the plate piece has a thickness of 0.2 mm-1.5 mm and a weight of 0.2 g-2.0 g.

The invention is suitable to be applied to a large-size golf club head particularly having a volume not smaller than 300 $cm^3$. In the case of a large-size head, a distorted abnormal sound is apt to be generated when a ball is hit. When the inventive structure is adopted, such an abnormal sound is prevented or suppressed.

In addition, the invention is suitable to be applied to a golf club head having a sole portion 0.5 mm-1.2 mm thick, with which head an abnormal sound is apt to be generated likewise. The sole portion may be substantially as thick as the plate piece.

The invention is suitable to be applied to a golf club head made of titanium or a titanium alloy, which head can be increased in size easily.

DETAILED DESCRIPTION OF THE INVENTION

Figure 1:
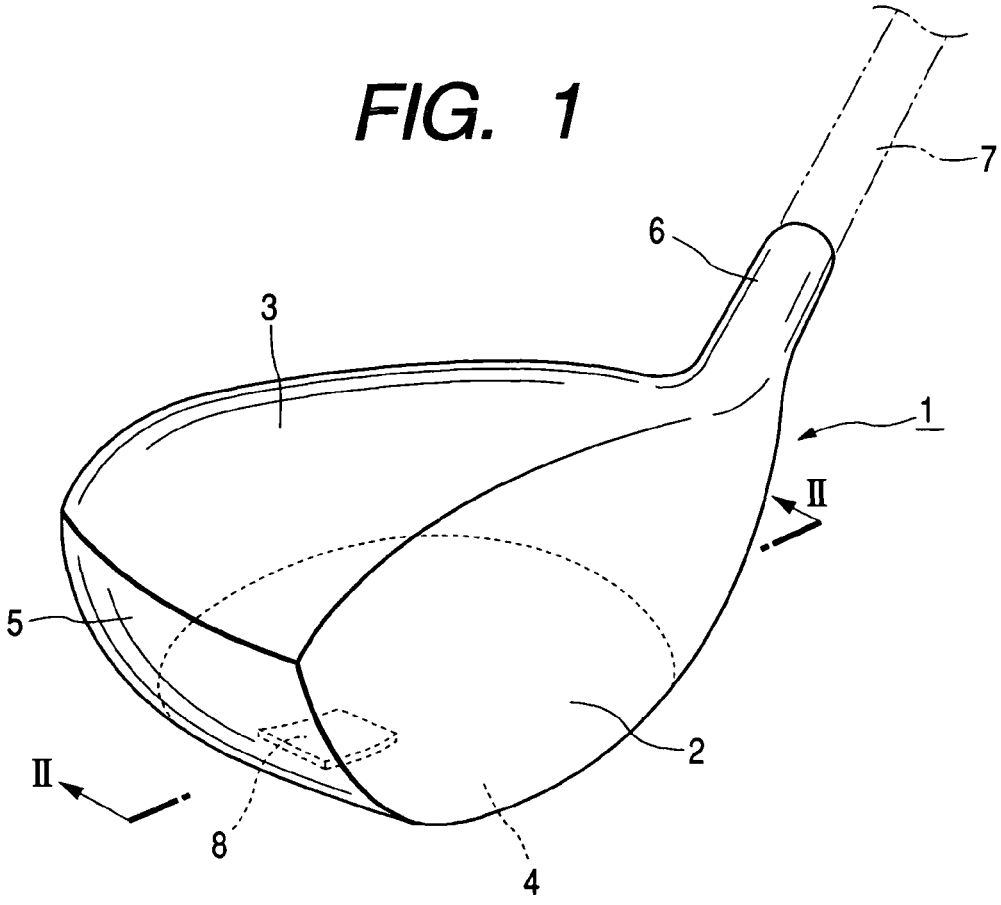
FIG. 1 is a perspective view of a golf club head according to an embodiment of the invention.
Figure 2:
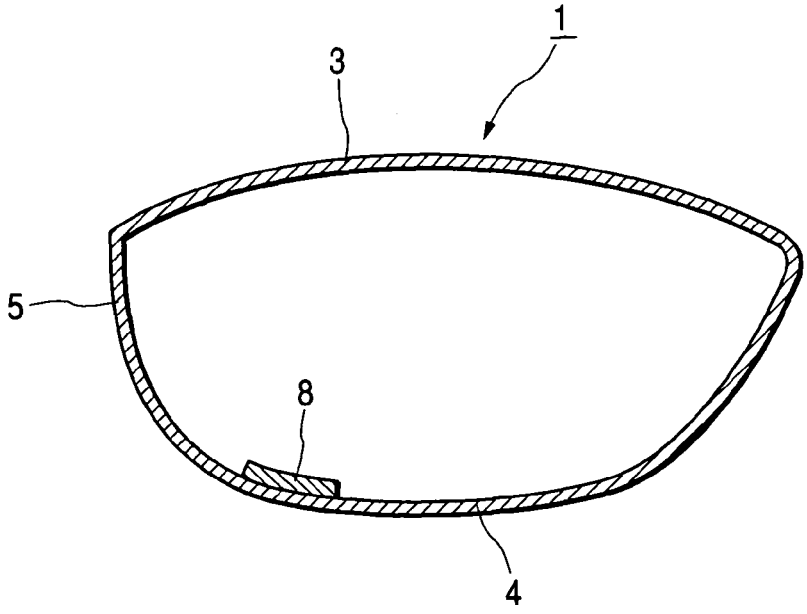
FIG. 2 is a sectional view of the golf club head in FIG. 1.
Figure 3:
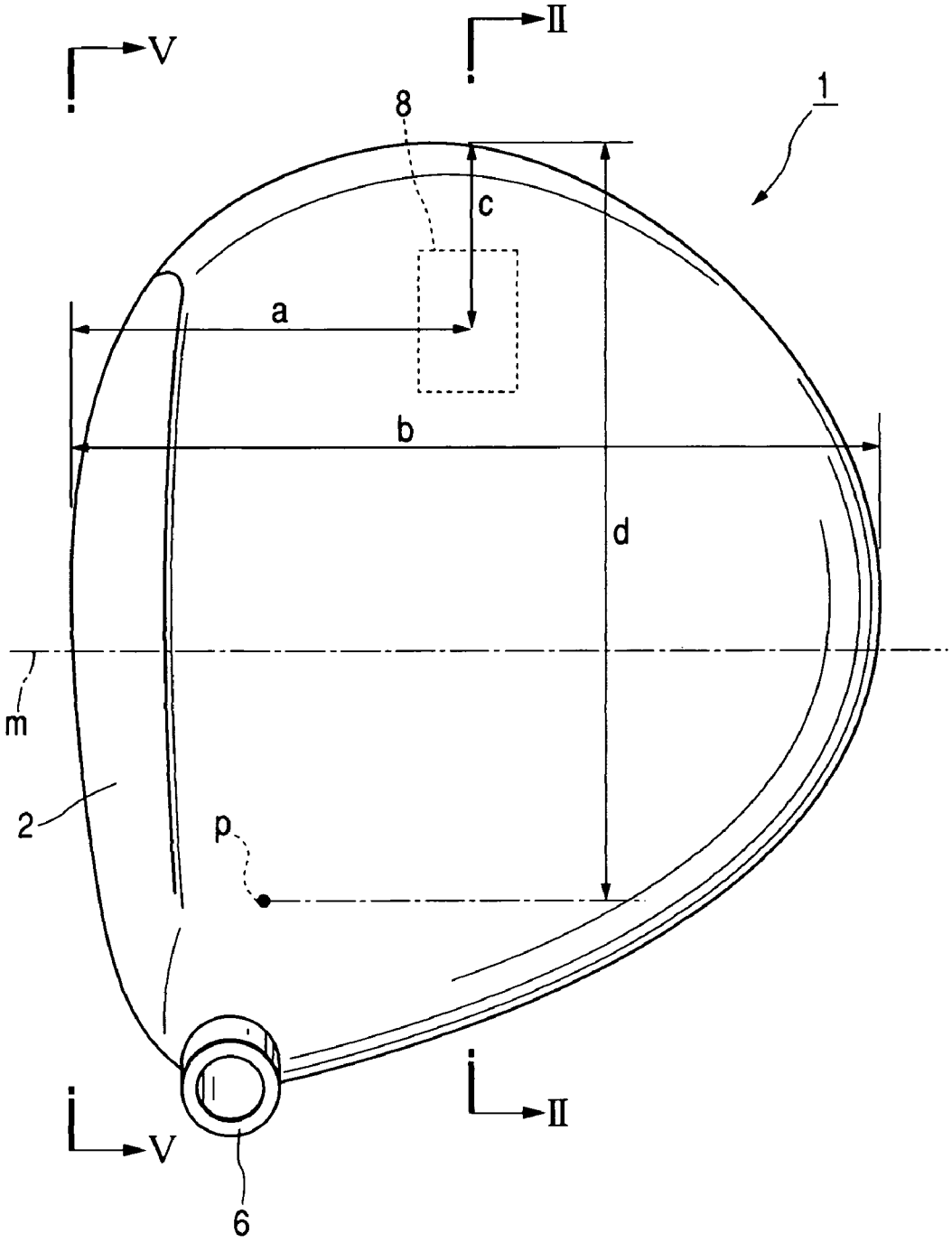
FIG. 3 is a plan view of the golf club head in FIG. 1.
Figure 4A:
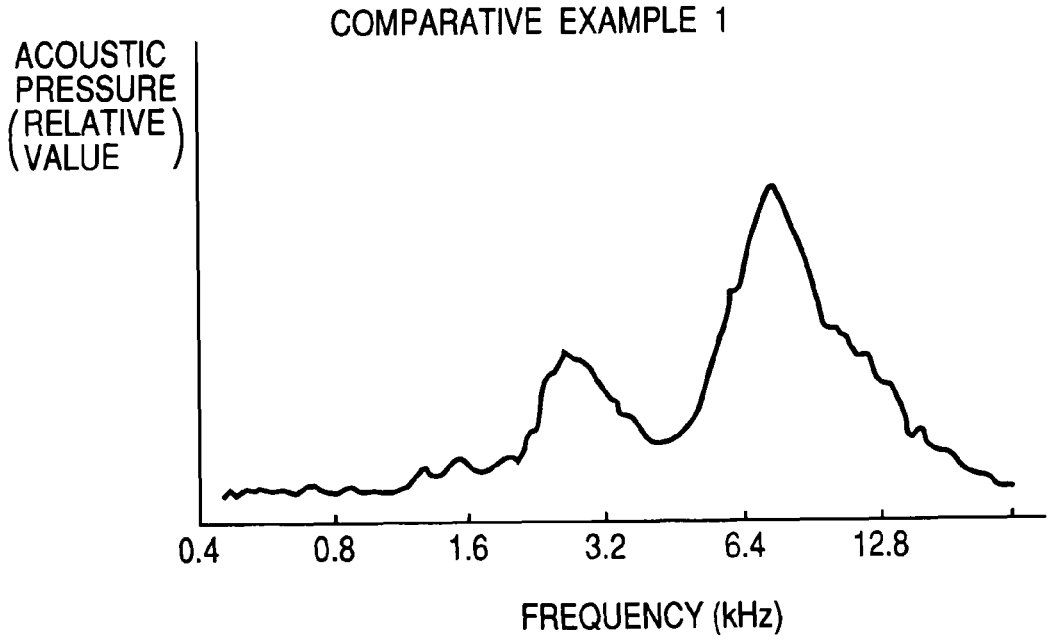
FIGS. 4A and 4B are graphs showing the measurement results of ball-hitting sound.
Figure 4B:
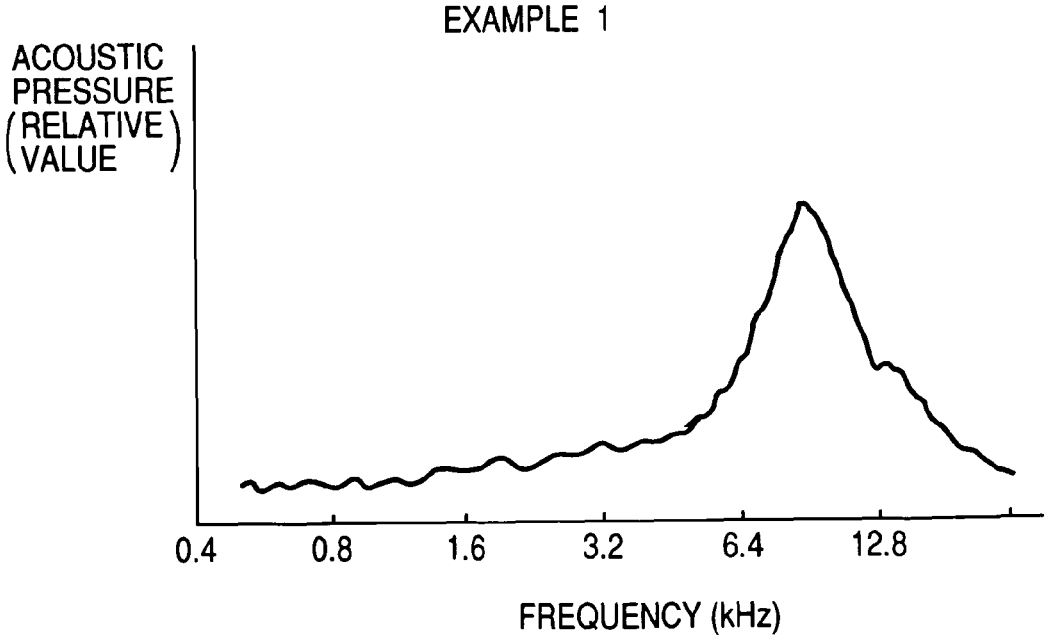
Figure 5:
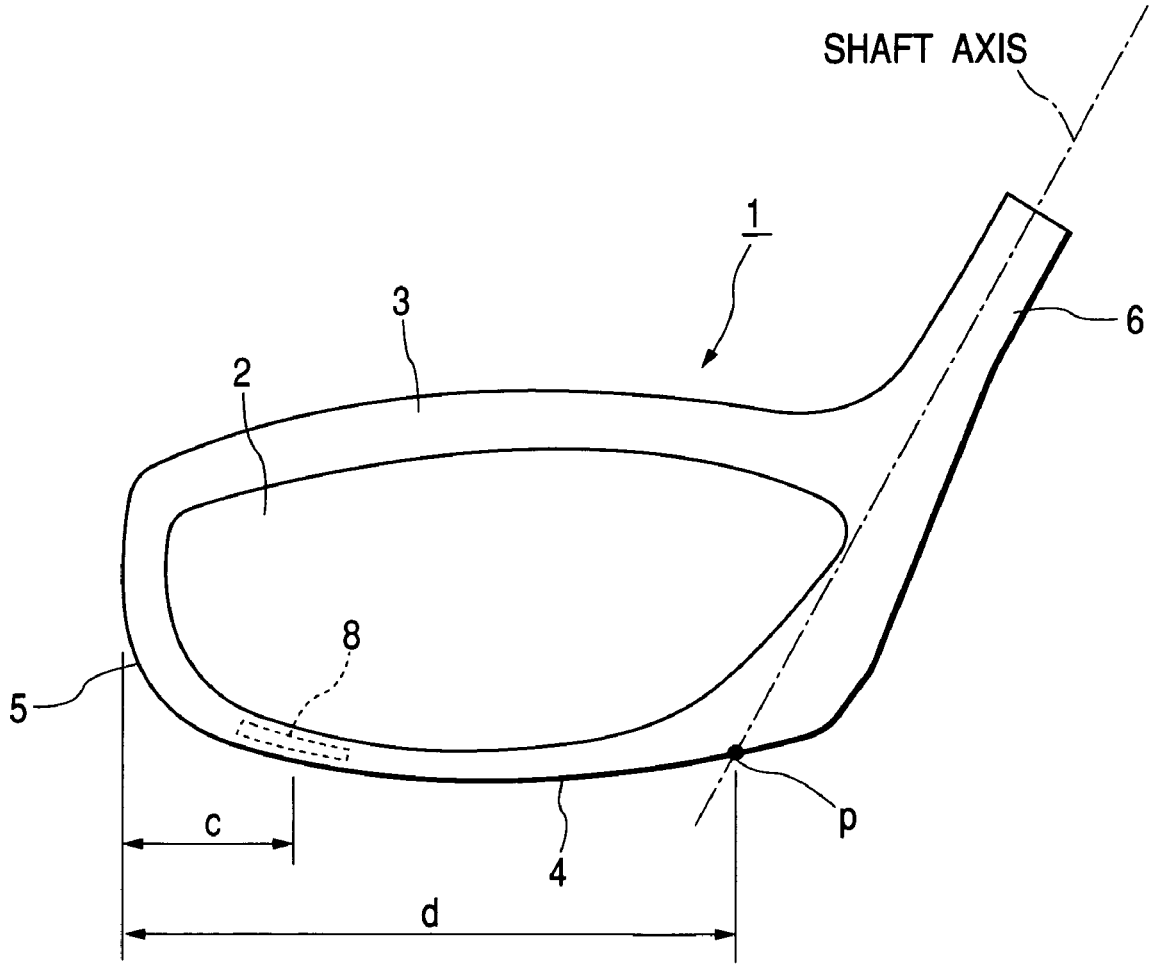
FIG. 5 is a sectional view taken on line V-V in FIG. 3.
Figure 6:
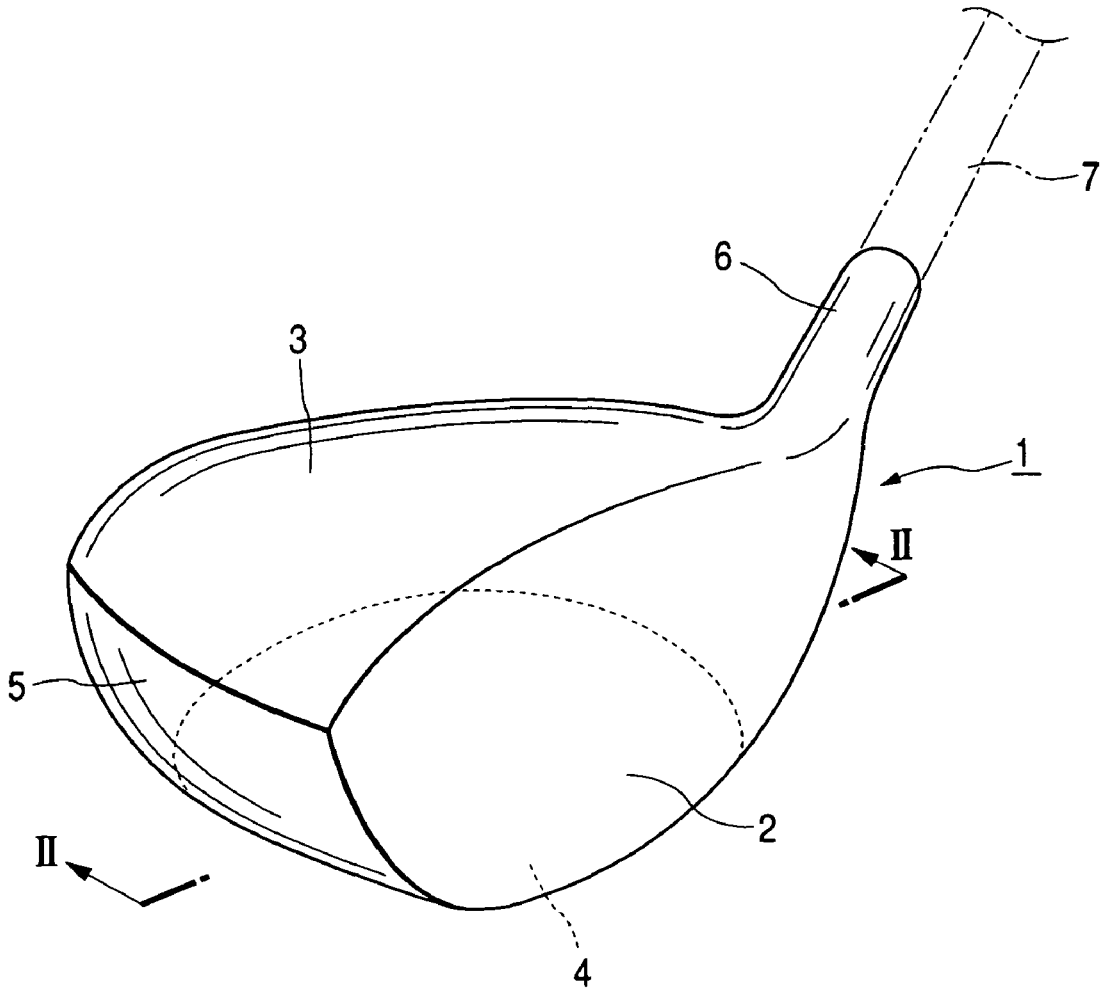
FIG. 6 PRIOR ART
FIG. 6 is a perspective view of a golf club head according to a related art.

Description will be made below on an embodiment of the invention with reference to the drawings. FIG. 1 is a perspective view of a golf club head according to an embodiment of the invention. FIG. 2 is a sectional view taken on line 11-11 in FIG. 1 and FIG. 3. FIG. 3 is a plan view of the golf club head. FIGS. 4A and 4B are graphs showing the measurement results of the sound of hitting a ball in examples, which will be described later. FIG. 5 is a sectional view on line V-V in FIG. 3.

This golf club head 1 is a hollow head made of metal, preferably titanium or a titanium alloy. The golf club head 1 has a face portion 2, a crown portion 3, a sole portion 4, a side portion 5 and a hosel portion 6. The face portion 2 is a ball-hitting surface. The crown portion 3 is a top surface, and the sole portion 4 is a bottom surface. The side portion 5 forms toe-side, back-side and heel-side side surfaces.

The hosel portion 6 may be provided to reach the sole portion 4, or may be provided not to reach the sole portion 4. A shaft 7 is inserted into the hosel portion 6 and fixedly attached thereto by a bonding agent. Thus, a golf club is formed.

In the golf club head 1, a thin and small plate 8 made of metal is fixedly attached to the internal surface of the sole portion 4 on the toe side to be in tight contact with the internal surface. Incidentally, as is well known, the toe side means a side opposite to the hosel portion 6, that is, a side distant from a golfer.

It is preferable that the thin and small plate 8 made of metal has a thickness of 0.2 mm-1.5 mm, particularly 0.4 mm-1.2 mm, more particularly 0.5 mm-1.0 mm, and a weight of 0.2 g-2.0 g, particularly 0.5 g-10.5 g. It is preferable that the planar area of the thin and small plate is 25 $mm^2$-1,600 $mm^2$, particularly about 100 $mm^2$-600 $mm^2$.

Titanium or a titanium alloy is preferred as a material of the thin and small plate 8. The material of the thin and small plate 8 may be the same as that of the golf club head. Incidentally, the material of the thin and small plate 8 is not limited thereto. For example, aluminum or an aluminum alloy having a lower specific gravity than that of the titanium alloy may be used.

It is essential for the thin and small plate 8 to be in tight contact with the internal surface of the sole portion 4 as a whole. Although it is desired that the thin and small plate 8 is fixedly attached to the sole portion 4 by welding, it may be fixedly attached by brazing or through an organic bonding agent.

For example, a shape of the thin and small plate 8 may be quadrate, triangular, polygonal with five or more sides, circular, elliptic, or astral.

The invention is suitable to be applied to a large-size golf club head having a volume not smaller than 300 $cm^3$, particularly not smaller than 320 $cm^3$, more particularly not smaller than 350 $cm^3$, with which an abnormal sound is apt to be generated when a ball is hit. An upper limit on the volume of a currently commercially available golf club head made of metal is about 500 $cm^3$. The invention is applicable even to a golf club head having a larger volume, for example, about 600 $cm^3$. Incidentally, when a golf club head is increased in size, each portion of the golf club head is obliged to be reduced in thickness in order to prevent the golf club head from increasing in weight. As a result of researches by the present inventors, it is found that an abnormal sound, particularly a bass-range abnormal sound is generated more easily at the time of hitting a ball with the golf club head as the golf club head is made thinner thus. The invention is superior in the effect of preventing such a bass-range abnormal sound at the time of hitting a ball with a large-size golf club head.

In order to secure sufficient strength in a golf club head in spite of its reduced thickness, the golf club head is preferably made of a β type titanium alloy, which can be made high in strength and high in hardness by heat treatment.

Examples of such β-type titanium alloys include Ti-15V-3Cr-3Sn-3Al, Ti-13V-11Cr-3Al, Ti-15Mo-5Zr, Ti-15Mo-5Zr-3Al, Ti-3Al-8V-6Cr-4Mo-4Zr, and Ti-22V-4Al.

An α-β type titanium alloy is also suitable for the material of the golf club head. Examples of such α-β type titanium alloys include Ti-6Al-4V and Ti-6Al-6V-2Sn.

A method for manufacturing the golf club head is not limited particularly. A forming technique such as casting, forging, press working, and rolling, a joining technique such as welding, and a heat treatment technique may be adopted in combination in accordance with necessity.

With regard to a position where the thin and small plate should be disposed, it is desirable that the following relations are satisfied in the plan view of the golf club head, as shown in FIGS. 3 and 5.

$$0.3 \leqq a/b \leqq 0.5$$

$$0.25 \leqq c/d \leqq 0.45$$

where a denotes a distance in a direction of a target line between the foremost portion of the golf club head and a center of the thin and small plate; b denotes the maximum width of the golf club head; c denotes a distance in a direction perpendicular to the target line between a toe-side tip end position (hereinafter referred to as "toe portion") of the golf club head and the center of the thin and small plate; and d denotes a distance in the direction perpendicular to the target line between the toe portion and an intersection p between an elongation of the shaft axis and the sole surface (bottom surface of the sole portion 4).

Incidentally, it is preferable that a distance in the direction of the target line between the foremost portion of the golf club head and the rearmost portion thereof is 80 mm-110 mm, particularly 85 mm-100 mm. In addition, it is preferable that a distance between the toe portion of the golf club head and a straight line m passing a center of the face portion of the golf club head in the direction of the target line is 75 mm-100 mm, particularly 80 mm-95 mm.

EXAMPLE

Description will be made below on Examples and Comparative Example. For the sake of convenience of description, Comparative Example will be described first.

Comparative Example 1

A golf club head shown in FIGS. 1 to 3 (without disposing a thin and small plate 8) was manufactured by use of Ti-15V-3Cr-3Sn-3Al (specific gravity 4.7), which was a β type titanium alloy. The volume of the golf club head was 350 $cm^3$. The thickness of the face portion was 3 mm while the thickness of the other portion of the golf club head was 1 mm.

The distance between the foremost portion of the golf club head and the rearmost portion thereof was 90 mm. The distance between the straight line m and the toe portion was 84 mm.

FIG. 4A shows the frequency distribution of the sound generated when a carbon shaft (45 inches long) was attached to the golf club head and a golf ball was hit with the golf club head at a head speed of 40 m/sec. Incidentally, in FIGS. 4A and 4B, a peak value of acoustic pressure was plotted in each frequency for 30 msec after the ball hitting.

As shown in FIG. 4A, in Comparative Example 1, a loud sound is generated near about 2.5 kHz in a bass range.

Example 1

A thin and small plate made of pure titanium having a thickness of 0.2 mm, dimensions of 24 mm by 24 mm and a weight of 0.5 g was fixedly attached to a position satisfying a/b=0.36 and c/d=0.38 by brazing. The frequency of a sound generated when a ball was hit was analyzed in the same manner as in Comparative Example 1. FIG. 4B shows the result. As shown in FIG. 4B, according to Example 1, the bass-range sound near 2.5 kHz disappeared. Ten persons catching this sound of hitting a ball recognized the sound as a sound higher-pitched and clearer than that in Comparative Example 1.

Examples 2 to 10

Golf club heads were manufactured so that the size (dimension) of the thin and small plate was changed as shown in Table 1 while with regard to an arrangement position of the golf club head, a center of the thin and small plate was identical to that in Example 1. Then, the sound of hitting a ball was measured in the same manner. As a result, the sound of hitting a ball with each golf club head was recognized as a sound high-pitched and clear.

Incidentally, a similar test was performed upon a golf club head having a sole portion thickness of 1 mm and a volume of 300 $cm^3$, and a golf club head having a sole portion thickness of 0.5 mm and a volume of 500 $cm^3$, respectively. In addition, a similar test was performed upon a golf club head manufactured in the same manner as in Example 1, except that the head was made of Ti-6Al-4V that was an α-β type titanium alloy. As a result, the sound of hitting a ball with each golf club head was recognized as a sound high-pitched and clear.

TABLE 1

| | thin and small plate | | |
|---|---|---|---|
| No. | thickness (mm) | dimensions (mm × mm) | weight (g) |
| Example 1 | 0.2 | 24 × 24 | 0.5 |
| Example 2 | 1.5 | 5 × 5 | 0.2 |
| Example 3 | 1.2 | 8 × 8 | 0.4 |
| Example 4 | 1 | 10 × 10 | 0.5 |
| Example 5 | 0.5 | 15 × 15 | 0.5 |
| Example 6 | 0.5 | 20 × 20 | 0.9 |
| Example 7 | 0.5 | 24 × 24 | 1.3 |
| Example 8 | 0.2 | 30 × 30 | 0.8 |
| Example 9 | 0.2 | 40 × 40 | 1.5 |
| Example 10 | 1 | 20 × 20 | 1.8 |

Example 11

A golf club head was manufactured in the same manner as in Example 1, except that the position of the thin and small plate was set to be closer to the back side than in Example 1, so as to satisfy a/b=0.55 and c/d=0.38. A similar ball-hitting sound test was performed upon this golf club head. A bass-range abnormal sound was caught slightly.

Example 12

A golf club head was manufactured in the same manner as in Example 1, except that the position of the thin and small plate was set to be closer to the heel side than in Example 1, so as to satisfy a/b=0.4 and c/d=0.53. A similar ball-hitting sound test was performed upon this golf club head. A bass-range abnormal sound was caught slightly.

Example 13

A golf club head was manufactured in the same manner as in Example 1, except that the position of the thin and small plate was set to be closer to the face side than in Example 1, so as to satisfy a/b=0.25 and c/d=0.40. A similar ball-hitting sound test was performed upon this golf club head. A bass-range abnormal sound was caught slightly.

As described above, according to the invention, a bass-range abnormal sound was eliminated from the sound of hitting a ball, so that a high-pitched and clear sound was generated. Thus, a golfer can know achievement of a satisfactory carry. Accordingly, on and after the next shot, the golfer will be relieved of the strain to make a big shot by force. As a result, the golfer will have a smooth swing in a relaxed mood so as to continue good shots.

What is claimed is:

1. A hollow golf club head made of metal, comprising:
a face portion;
a sole portion;
a side portion;
a crown portion; and
a plate piece made of metal and fixedly attached to an internal surface of the golf club head on a toe side of the sole portion so that one surface thereof is in tight contact with the sole portion,
wherein the plate piece is disposed such that a bass-range sound is dampened.

2. The golf club head according to claim 1, wherein the golf club head has a volume not smaller than 300 $cm^3$.

3. The golf club head according to claim 1, wherein the sole portion has a thickness of 0.5 mm-1.2 mm.

4. The golf club head according to claim 1, wherein the metal forming the golf club head is one of titanium and a titanium alloy.

5. The golf club head according to claim 1, wherein the bass-range comprises 2.5 KHz.

6. The golf club head according to claim 1, wherein the plate piece is brazed to the internal surface of the golf club head.

7. The golf club head according to claim 1, wherein the plate piece is disposed at a point distant from the side portion.

8. A hollow golf club head made of metal, comprising:
a face portion;
a sole portion;
a side portion;
a crown portion; and
a plate piece made of metal and fixedly attached to an internal surface of the golf club head on a toe side of the sole portion so that one surface thereof is in tight contact with the sole portion,
wherein the plate piece has a thickness of 0.2 mm-1.5 mm and a weight of 0.2 g-1.5 g.

9. The golf club head according to claim 8, wherein the golf club head has a volume not smaller than 300 $cm^3$.

10. The golf club head according to claim 8, wherein the sole portion has a thickness of 0.5 mm-1.2 mm.

11. The golf club head according to claim 8, wherein the metal forming the golf club head is one of titanium and a titanium alloy.

12. The golf club head according to claim 8, wherein the plate piece is brazed to the internal surface of the golf club head.

13. The golf club according to claim 8, wherein a surface of the plate piece has an area in a range of 25 $mm^2$ to 1,600 $mm^2$.

14. The golf club head according to claim 8, wherein the golf club head is made of β type titanium alloy.

15. The golf club head according to claim 8, wherein the plate piece is made of titanium or titanium alloy.

16. The golf club head according to claim 8, wherein the plate piece is made of aluminum or aluminum alloy.

17. The golf club head according to claim 8, wherein the plate piece is disposed at a point distant from the side portion.

* * * * *